US010571853B2

(12) United States Patent
Ito

(10) Patent No.: US 10,571,853 B2
(45) Date of Patent: Feb. 25, 2020

(54) OPEN/CLOSE ASSEMBLY AND IMAGE FORMING APPARATUS

(71) Applicant: BROTHER KOGYO KABUSHIKI KAISHA, Nagoya-shi, Aichi-ken (JP)

(72) Inventor: Sakae Ito, Kitanagoya (JP)

(73) Assignee: BOTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 16/389,416

(22) Filed: Apr. 19, 2019

(65) Prior Publication Data

US 2019/0354060 A1 Nov. 21, 2019

(30) Foreign Application Priority Data

May 15, 2018 (JP) ..... 2018-093551

(51) Int. Cl.
*G03G 21/16* (2006.01)

(52) U.S. Cl.
CPC ..... *G03G 21/1628* (2013.01); *G03G 21/1633* (2013.01)

(58) Field of Classification Search
CPC ..... G03G 21/1623; G03G 21/1628; G03G 21/1633; G03G 2221/1687
See application file for complete search history.

(56) References Cited

U.S. PATENT DOCUMENTS 6,510,301 B2 * 1/2003 Tanaka ..... G03G 15/605 399/125
8,837,988 B1 * 9/2014 Hara ..... B41J 29/54 399/125
9,065,946 B2 * 6/2015 Inada ..... H04N 1/00554
2015/0248105 A1 9/2015 Aoi
2018/0257883 A1 * 9/2018 Oyama ..... H04N 1/00554

FOREIGN PATENT DOCUMENTS

JP 2015-161928 A 9/2015
JP 2017-53988 A 3/2017

* cited by examiner

*Primary Examiner* — Carla J Therrien
(74) *Attorney, Agent, or Firm* — Merchant & Gould P.C.

(57) ABSTRACT

An open/close assembly, having a first housing with an aperture; a second housing being openable and closable to the first housing; a first protrusion arranged in the second housing and movable between a first position protruding from the second housing to be inserted in the aperture and a second position being more inward than the first position; a spring arranged in the second housing and configured to urge the first protrusion toward the second position; a sensor arranged in the first housing and configured to detect the first protrusion inserted in the aperture; and an actuator with a surface configured to move the first protrusion to the first position when the second housing is being closed and to move the first protrusion to the second position when the second housing is being opened, is provided.

10 Claims, 11 Drawing Sheets

OPEN/CLOSE ASSEMBLY AND IMAGE FORMING APPARATUS

CROSS REFERENCE TO RELATED APPLICATION

This application claims priority from Japanese Patent Application No. 2018-093551, filed on May 15, 2018, the entire subject matter of which is incorporated herein by reference.

BACKGROUND

Technical Field

An aspect of the present disclosure is related to an open/close assembly and an image forming apparatus.

Related Art

Open/close assemblies are known. An open/close assembly may have an interlocking switch. The interlocking switch may be switched on and off in conjunction with opening and closing motions of a cover. For example, the cover may have a protrusion, and when the cover is being closed, the protrusion may be inserted in an aperture for the switch formed in a housing to press the interlocking switch disposed inside the housing.

SUMMARY

The aperture for the switch may be formed to have a substantially small size to restrict entry of a user's finger. Accordingly, the protrusion to be inserted in the aperture may as well have a substantially small size. In this regard, the protrusion on the cover may be easily deformed or damaged by, for example, external contact.

The present disclosure is advantageous in that an open/close assembly and an image forming apparatus, having a protrusion to be detected by a sensor and capable of restraining deformation and damage of the protrusion, are provided.

According to an aspect of the present disclosure, an open/close assembly, including a first housing, a second housing, a first protrusion, a spring, a sensor, and an actuator, is provided. The first hosing includes an aperture. The second housing is openable and closable to the first housing. The first protrusion is arranged in the second housing and is movable between a first position, in which the first protrusion protrudes from the second housing, and a second position being more inward in the second housing than the first position. The first protrusion protruding from the second housing is configured to be inserted in the aperture in a condition where the second housing is closed. The spring is arranged in the second housing and is configured to urge the first protrusion toward the second position. The sensor is arranged in the first housing and is configured to detect the first protrusion inserted in the aperture. The actuator has a surface which is configured to move the first protrusion to the first position when the second housing is being closed and to move the first protrusion to the second position when the second housing is being opened.

According to an aspect of the present disclosure, an image forming apparatus, including an open/close assembly and an image forming unit, is provided. The open/close assembly includes a first housing, a second housing, a first protrusion, a spring, a sensor, and an actuator. The first hosing includes an aperture. The second housing is openable and closable to the first housing. The first protrusion is arranged in the second housing and is movable between a first position, in which the first protrusion protrudes from the second housing, and a second position being more inward in the second housing than the first position. The first protrusion protruding from the second housing is configured to be inserted in the aperture in a condition where the second housing is closed. The spring is arranged in the second housing and is configured to urge the first protrusion toward the second position. The sensor is arranged in the first housing and is configured to detect the first protrusion inserted in the aperture. The actuator has a surface which is configured to move the first protrusion to the first position when the second housing is being closed and to move the first protrusion to the second position when the second housing is being opened. The image forming unit is configured to form an image on a sheet and is arranged in the first housing and the second housing of the open/close assembly.

BRIEF DESCRIPTION OF THE ACCOMPANYING DRAWINGS

DETAILED DESCRIPTION

In the following paragraphs, described with reference to the accompanying drawings will be first through third embodiments of the present disclosure.

First Embodiment

Figure 1:
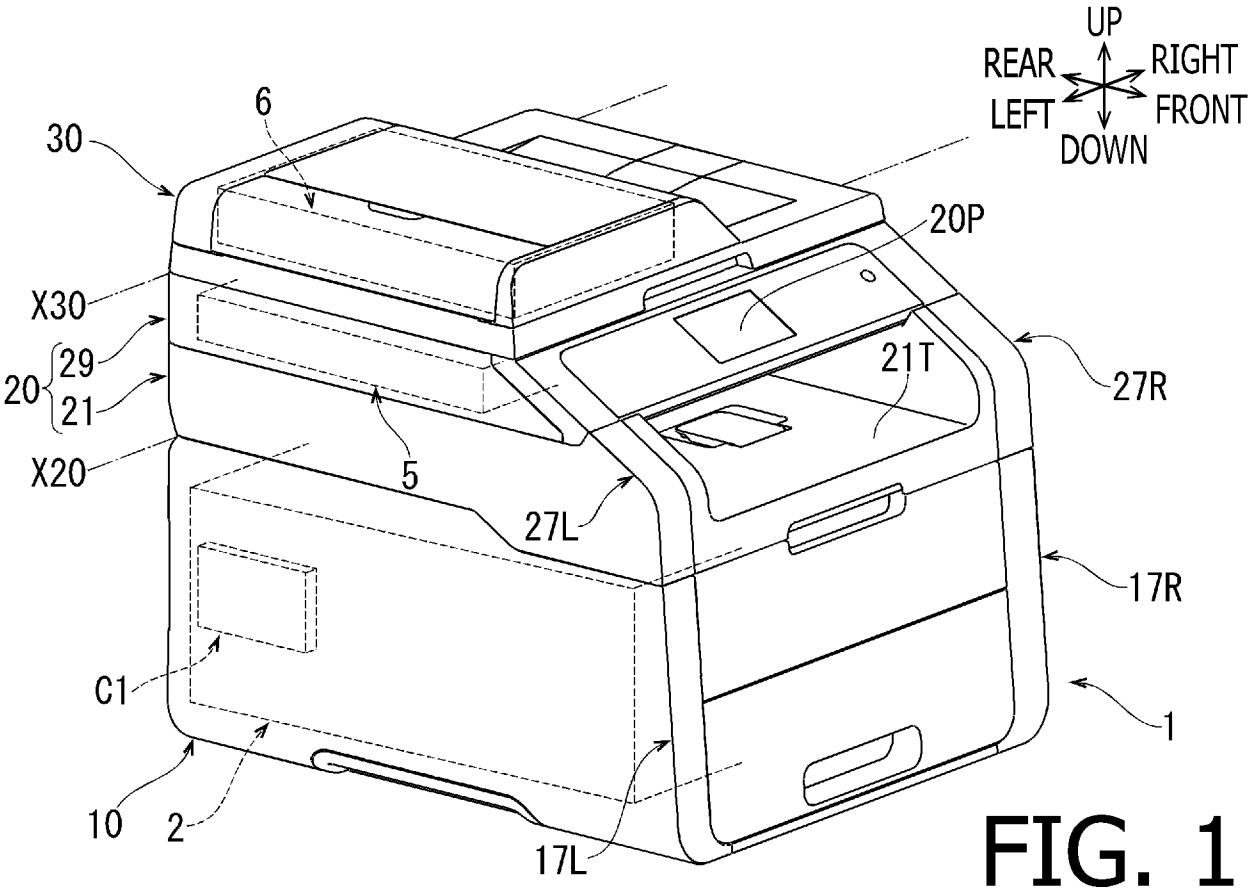
FIG. 1 is a perspective view of an image forming apparatus according to a first embodiment of the present disclosure.

An image forming apparatus 1 according to the first embodiment of the present disclosure, as shown in FIG. 1, may be a color laser printer having an open/close assembly.

In the following description, directions related the image forming apparatus 1 and parts or items included in the image forming apparatus 1 will be mentioned on basis of directions indicated by arrows in each drawing. For example, in FIG. 1, a side, on which an operation panel 20P is arranged, will be referred to as a front side of the image forming apparatus 1, and a user may stand to face the front side of the image forming apparatus 1 in order to ordinarily use the image forming apparatus 1. A side opposite to the front side, which is the user's farther side, may be called as a rear side. The user's left-hand side and right-hand side may be referred to as a leftward side and rightward side, respectively. Moreover, a left-to-right or right-to-left direction to the user may be called as a crosswise direction. An up-to-down or down-to-up direction to the user may be called as a vertical direction. The directions shown in FIGS. 2-11 are defined in the same manner and correspond to the indications by the arrows appearing in FIG. 1.

<Overall Configuration>

As shown in FIG. 1, the image forming apparatus 1 includes a first housing 10, a second housing 20, an open/close unit 30, an image forming unit 2, a reader unit 5, an auto-feeder unit 6, and a controller C1.

Figure 2:
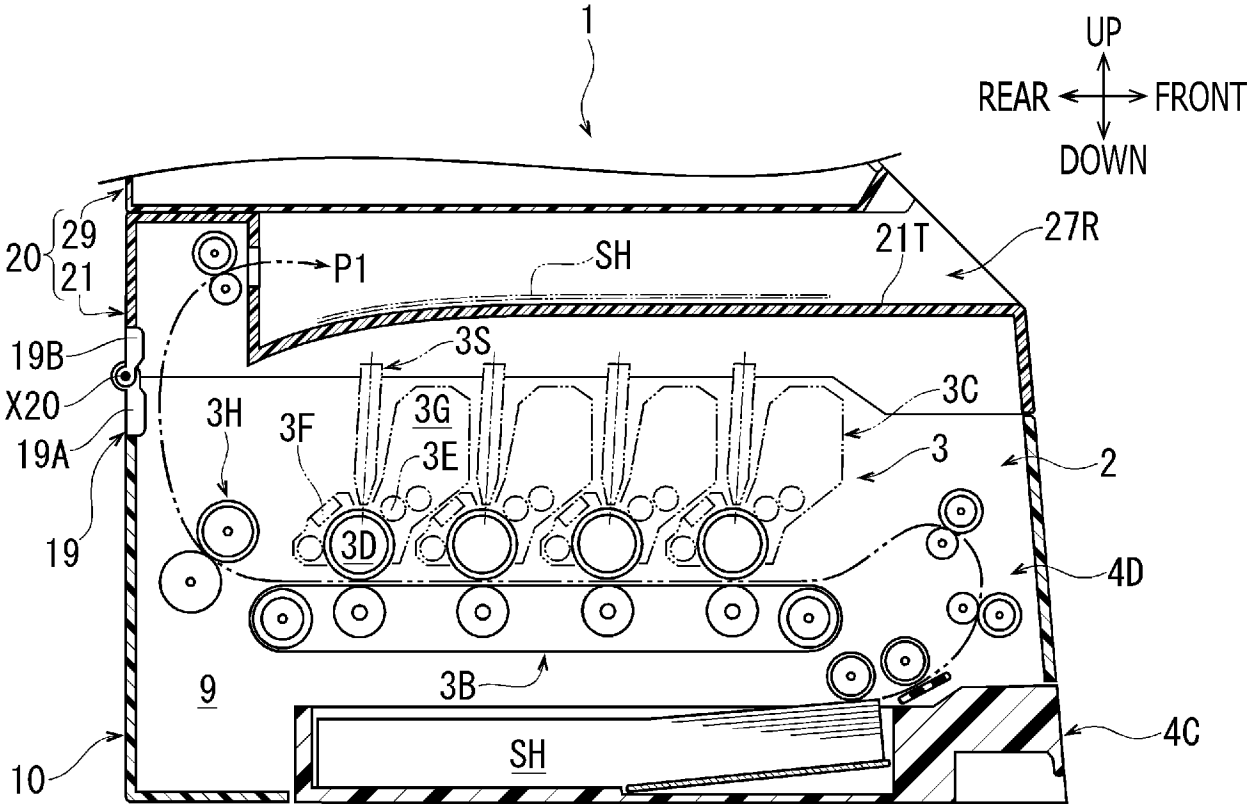
FIG. 2 is an illustrative cross-sectional view of the image forming apparatus according to the first embodiment of the present disclosure.
Figure 3:
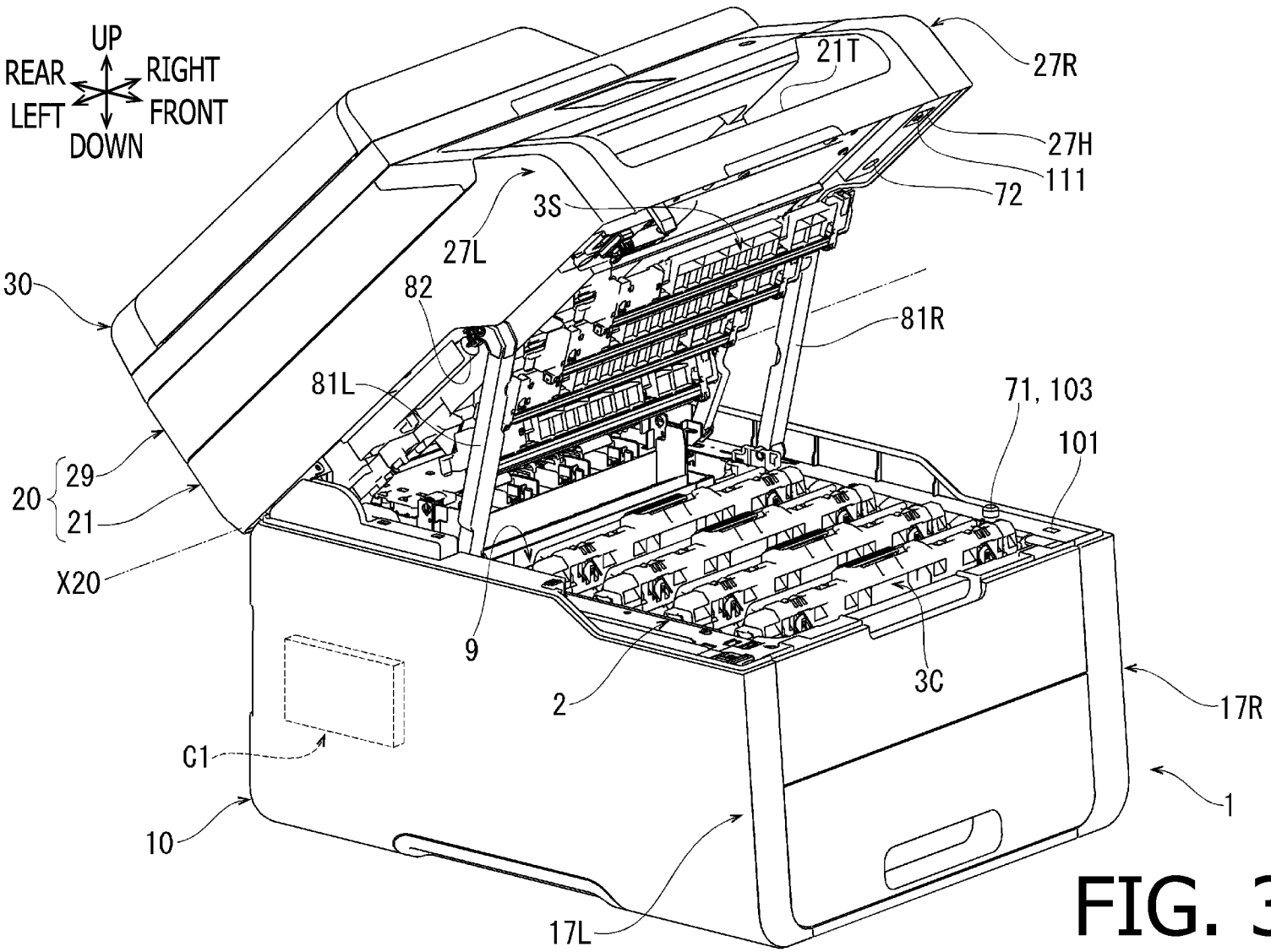
FIG. 3 is a perspective view of the image forming apparatus, with a second housing being in an open posture with respect to a first housing, according to the first embodiment of the present disclosure.
Figure 4:
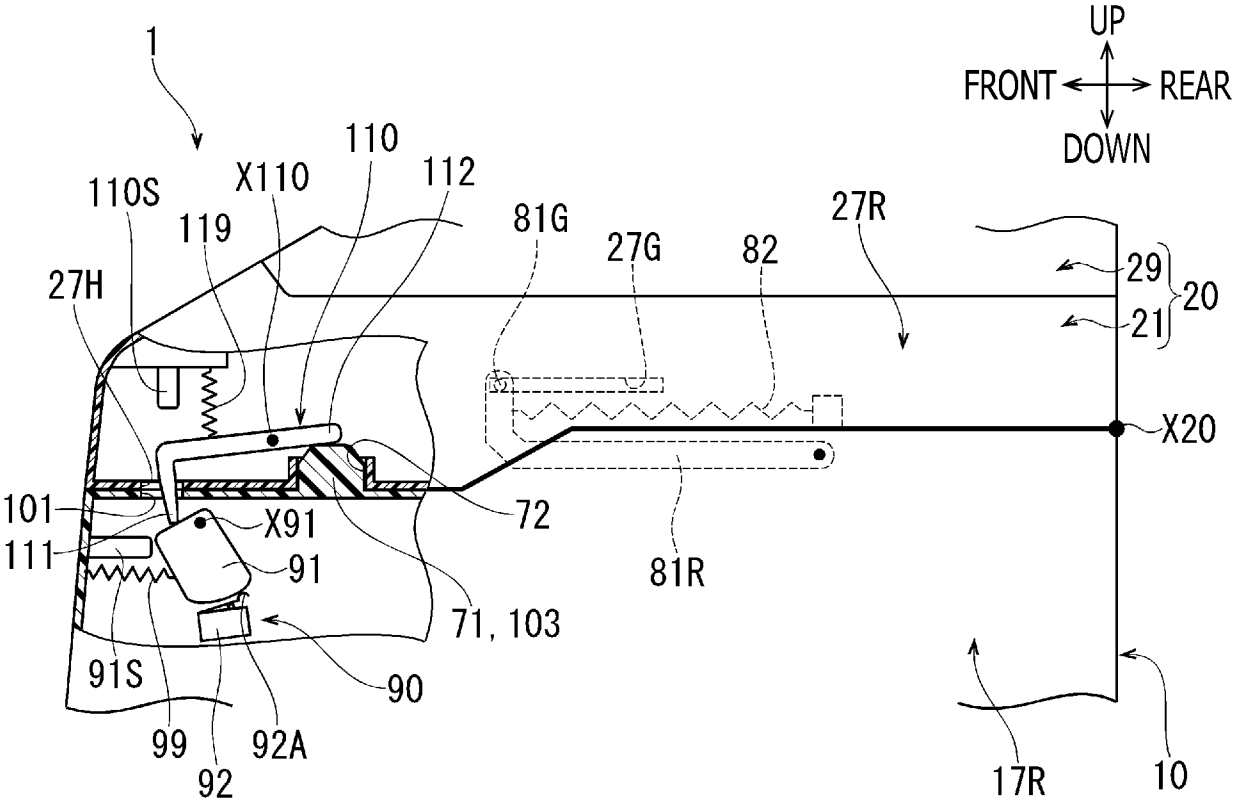
FIG. 4 is an illustrative cross-sectional partial view of the image forming apparatus, including a protrusion, a tension coil spring, an aperture, a sensor, and an actuator, with the second housing being in a closed posture with respect to the first housing, according to the first embodiment of the present disclosure.

As shown in FIGS. 2-3, the first housing 10 has a form of an approximately top-open box. As shown in FIG. 3, the first housing 10 includes first lateral walls 17L, 17R, which are arranged a leftward side and rightward side, respectively. A leftward surface of the first lateral wall 17L on the left forms a leftward side face of the first housing 10. Meanwhile, as shown in FIG. 4, a rightward surface of the first lateral wall 17R on the right forms a rightward side face of the first housing 10.

As shown in FIG. 1, the second housing 20 is arranged on top of the first housing 10. The second housing 20 includes a cover 21 and a flatbed 29. The second housing 20 covers an upper side of the first housing 10 by the cover 21. An area enclosed by the first housing 10 and the cover 21 of the second housing 20, as shown in FIG. 2, will be called as a container room, in which the image forming unit 2 and the controller C1 are stowed. As will be described in detail further below, the second housing 20 is openable and closable to the first housing 10.

As shown in FIG. 1, the cover 21 includes an ejection tray 21T and second lateral walls 27L, 27R, which are arranged on a leftward side and a rightward side, respectively. The ejection tray 21T is formed on an upper side of the cover 21 between the second lateral wall 27L and the second lateral wall 27R. The second lateral wall 27L on the left is arranged on top of the first lateral wall 17L, and the second lateral wall 27R on the right is arranged on top of the first lateral wall 17R. The second lateral walls 27L, 27R stand upward to be higher than the ejection tray 21T.

The flatbed 29 is supported by upper ends of the second lateral walls 27L, 27R at a position spaced apart upward from the ejection tray 21T. Inside the flatbed 29, stowed is the reader unit 5.

The reader unit 5 may be in a known configuration; therefore, detailed explanation and illustration of that will be herein omitted. On an upper side of the flatbed 29, arranged is a platen glass, on which a document sheet to be read may be placed. In an area underneath the platen glass, a reader sensor may move and read an image of the document sheet.

In a frontward area of the flatbed 29, arranged is the operation panel 20P. The operation panel 20P may be controlled by the controller C1 to display information such as an operation status and settings in the image forming apparatus 1. Moreover, the operation panel 20P may accept input by the user and transmit the input to the controller C1.

The open/close unit 30 is arranged on top of the second housing 20. The open/close unit 30 is supported swingably by a hinge, which is arranged at a rear end of the second housing 20 but is not shown, to swing about an open/close axis X30 extending in the crosswise direction. The open/close unit 30, when in a closed posture as shown in FIG. 1, covers an upper surface of the flatbed 29. Although not shown in the accompanying drawings, the open/close unit 30 may swing about the open/close axis 30 with a frontward portion thereof moving upward and rearward to be in an open posture to expose the upper surface of the flatbed 29. With the open/close unit 30 being placed in the open posture, the user may place the document sheet to be read on the upper surface of the flatbed 29.

Inside the open/close unit 30, stowed is the auto-document feeder 6. The auto-document feeder 6 may be in a known configuration; therefore, detailed explanation and illustration of that will be herein omitted. The auto-document feeder 6 may convey one or more document sheets sequentially over a predetermined reading position on the upper surface of the flatbed 29 so that images of the document sheets being conveyed may be sequentially read by the reader sensor.

<Controller>

The controller C1 is, as shown in FIG. 3, arranged on the first lateral wall 17L in the container room 9. The controller C1 includes a microcomputer, including a CPU, ROM, and a RAM, which are not shown. The ROM may store programs for controlling behaviors of the image forming apparatus 1 and for executing variety of processes. The RAM may serve as a memory area to temporarily store data and signals, which may be used by the CPU to run the programs, and as a work area to process the data. The controller C1 may control overall behaviors of the image forming apparatus 1 including the image forming unit 2, the reader unit 5, the auto-document feeder 6, and the operation panel 20P.

<Image Forming Unit>

The image forming unit 2 includes, as shown in FIG. 2, a sheet cassette 4C, a conveyer 4D, and an image printer 3.

The sheet cassette 4C is arranged at a lower area in the container room 9 in the first housing 10. The sheet cassette 4C may store one or more sheets SH in a stack therein. The conveyer 4D may pick up and convey the sheets SH one-by-one from the sheet cassette 4C along a conveyer path P1, which curves approximately in a cross-sectional shape of S, and eject the sheets SH at the ejection tray 21T.

The image printer 3 is arranged at an upper position with respect to the sheet cassette 4C in the container room 9. The sheets SH conveyed by the conveyer 4D along the conveyer path P1 may travel through the image printer 3 in a substantially horizontal part of the conveyer path P1.

The image printer 3 may be a direct tandem printer, capable of printing images in multiple colors. The image printer 3 includes a developing-toner cartridge 3C, a transfer belt 3B, exposing LED heads 3S, and a fuser 3H.

The developing-toner cartridge 3C is an assembly of four (4) cartridges corresponding to four (4) colors of toners, which are black, yellow, magenta, and cyan, aligning in line along the horizontal part of the conveyer path P1. The developing-toner cartridge 3C includes four (4) photosensitive drums 3D, and in the vicinity of each photosensitive drum 3D, arranged are a developing roller 3E, a charger 3F, and a toner container 3G. The transfer belt 3B is located at a lower position with respect to the photosensitive drums 3D across the horizontal part of the conveyer path P1. The transfer belt 3B, alongside the photosensitive drums 3D, may nip the sheet SH being conveyed and circulate. Meanwhile, four (4) exposing LED heads 3S are arranged in positions corresponding to the four photosensitive drums 3D. Each of the exposing LED heads 3S may emit light at the corresponding one of the photosensitive drums 3D from an upper position in the developing-toner cartridge 3C. The fuser 3H may nip the sheet SH exiting the position below the developing-toner cartridge 3C and apply heat and pressure to the sheet SH.

In order to form an image on the sheet SH in the image forming device 3, surfaces of the photosensitive drums 3D may be evenly charged positively by the chargers 3F as the photosensitive drums 3D rotate and exposed to the light from the exposing LED heads 3S. Thereby, electrostatic latent images may be formed in the areas on the surfaces of the photosensitive drums 3D exposed to the light. Thereafter, the toners in the toner containers 3G may be supplied to the electrostatic latent images on the surfaces of the photosensitive drums 3D, and the toners on the surfaces of the photosensitive drums 3D in the forms of the electrostatic latent images may be transferred onto the sheet SH. The sheet SH with the transferred images may be heated and pressed by the fuser 3H so that the transferred toners may be fixed on the sheet SH. Thereafter, the sheet SH with the fixed images thereon may be conveyed by the conveyer 4D to be ejected at the ejection tray 21T.

It may be noted that the image forming unit 2 may not necessarily be a laser printer capable of forming images in the electro-photographic method but may be, for example, an inkjet printer.

<Openable/Closable Structure of the Second Housing with Respect to the First Housing>

In the image forming apparatus 1, in order to conduct maintenance works, for example, for exchanging consumable items in the image forming unit 2 or removing a jammed sheet SH, the second housing 20 is openable and closable with respect to the first housing 10.

As illustrated in FIG. 2, a hinge 19 is arranged at a rear end of the image forming apparatus 1 between the first housing 10 and the second housing 20. In particular, to a rear end of the first housing 10, fixed is a base part 19A of the hinge 19. A movable part 19B of the hinge 19 is swingably coupled to the base part 19A to swing about an open/close axis X20, which extends in the crosswise direction. Meanwhile, the movable part 19B of the hinge 19 is fixed to a rear end of the second housing 20. Therefore, the second housing 20 is swingably supported by the first housing 10 to swing about the open/close axis 20.

The crosswise direction, in which the open/close axis 20 extends, is a widthwise direction for the first housing 10 and the second housing 20. A side of the first housing 10 toward one end in the widthwise direction may be a rightward side of the first housing 10, and a side of the second housing 20 toward one end in the widthwise direction may be a rightward side of the second housing 20.

Figure 5:
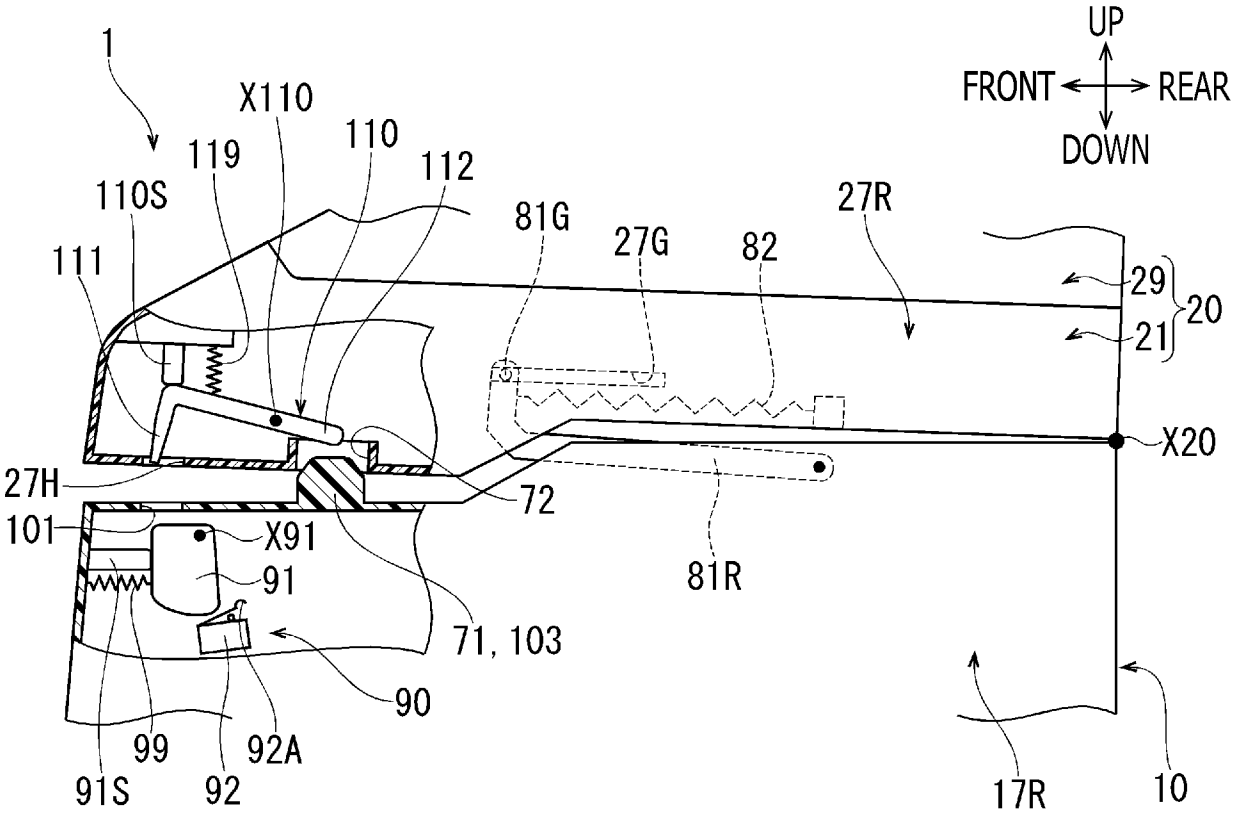
FIG. 5 is an illustrative cross-sectional partial view of the image forming apparatus, including the protrusion, the tension coil spring, the aperture, the sensor, and the actuator, with the second housing being in an open posture with respect to the first housing, according to the first embodiment of the present disclosure.
Figure 6:
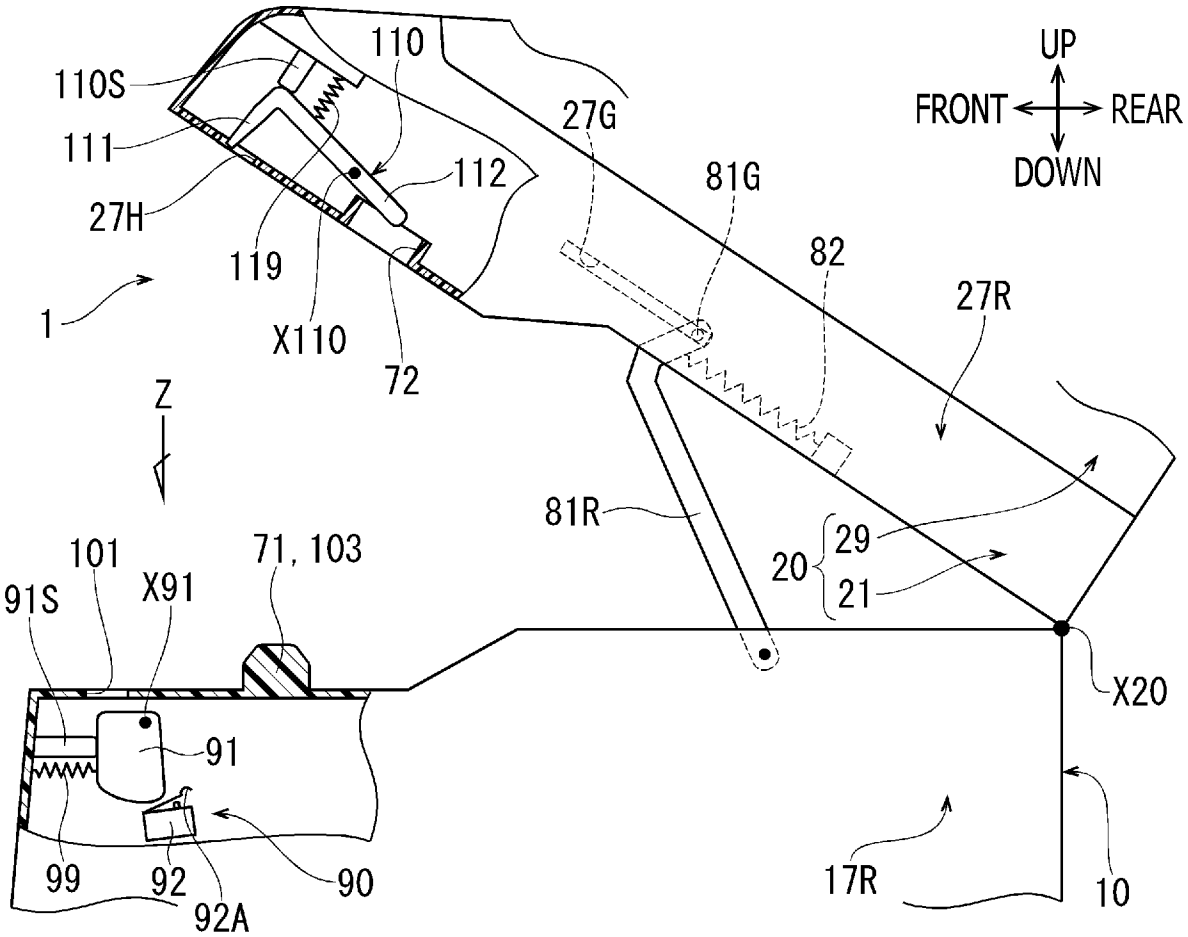
FIG. 6 is an illustrative cross-sectional partial view of the image forming apparatus, including the protrusion, the tension coil spring, the aperture, the sensor, and the actuator, with the second housing being in a wider open posture with respect to the first housing, according to the first embodiment of the present disclosure.

The second housing 20 may swing about the open/close axis 20 from a closed posture, as shown in FIGS. 1, 2, and 4, with a frontward portion thereof moving upward and rearward to be in an open posture, as shown in FIGS. 3, 5, and 6, to expose the upper side of the first housing 10. With the second housing 20 staying in the open posture, the user may conduct the maintenance works, for example, for exchanging consumable items in the image forming unit 2 and for removing a jammed sheet SH.

As shown in FIG. 3, the exposing LED heads 3S are attached to a lower side of the cover 21 in the second housing 20. When the second housing 20 is in the open posture, the exposing LED heads 3S are separated upward from the developing-toner cartridge 3C in the container room 9. Meanwhile, in FIGS. 4-6, illustration of the exposing LED heads 3S attached to the second housing 20 is omitted for simplicity in the drawings.

As shown in FIG. 3, between the first housing 10 and the second housing 20, arranged are arm-formed links 81L, 81R. A lower end of the link 81L on the left is coupled to an upper end of the first lateral wall 17L of the first housing 10. A lower end of the link 81R on the right is coupled to an upper end of the first lateral wall 17R of the first housing 10.

As shown in FIG. 4, to an upper end of the link 81R on the right, fixed is a guide pin 81G. In the second lateral wall 27R of the second housing 20, formed is a guide rail 27G being a groove extending in the front-rear direction. The guide pin 81G is arranged in the guide rail 27G in the second lateral wall 27R and may be guided in the guide rail 27G to slide in the front-rear direction. The upper end of the link 81R on the right is pulled, or urged, rearward by a tension coil spring 82 arranged on the second lateral wall 27R of the second housing 20.

Although not shown in the drawings, to an upper end of the link 81L on the left, fixed is a guide pin 81G. In the second lateral wall 27L of the second housing 20, formed is a guide rail 27G being a groove extending in the front-rear direction. The guide pin 81G is arranged in the guide rail 27G in the second lateral wall 27L and may be guided in the guide rail 27G to slide in the front-rear direction. The upper end of the link 81L on the left is pulled, or urged, rearward by a tension coil spring 82 arranged on the second lateral wall 27L of the second housing 20.

When the second housing 20 is moved from the closed posture with respect to the first housing 10, as shown in FIG. 4, to the open posture as shown in FIGS. 5 and 6, the guide pins 81G on the left and the right may be guided in the guide rails 27G, and the upper ends of the links 81L, 81R on the left and the right may move rearward. Meanwhile, by the aid of a resilient force accumulated in the tension coil springs 82 being released gradually, the user may move the second housing 20 to open with a smaller amount of lifting force.

Moreover, while the second housing 20 is in the open posture, the tension coil springs 82 may urge the upper ends of the links 81L, 81R rearward so that the links 81L 81R may support the second housing 20 to stay at the open posture.

On the other hand, when the second housing 20 is moved to be closed, the guide pins 81G may be guided in the opposite direction in the guide rails 27G, and the upper ends of the links 81L, 81R may move frontward. Meanwhile, the tension coil springs 82 may accumulate the resilient force therein gradually; therefore, the second housing 20 may be restrained from descending too rapidly.

As shown in FIGS. 3-6, the first housing 10 includes a first positioning portion 71, and the second housing 20 includes a second positioning portion 72. The first positioning portion 71 is arranged on a rightward side of the first housing 10, and the second positioning portion 72 is arranged on a rightward side of the second housing 20.

The first positioning portion 71 may include a protrusion that protrudes upward from an upper surface at a frontward area of the first lateral wall 17R of the first housing 10. In other words, the first positioning portion 71 is a part of the first housing 10 having a protruded shape. A lower part of the first positioning portion 71 is in a cylindrical shape, and an upper part of the first positioning portion 71 is in a frustum conical shape having a top plane surface.

The second positioning portion 72 may be a round opening recessed into a lower surface to be open upward at a frontward position of the second lateral wall 27R of the second housing 20. For example, the second positioning portion 72 may be a round opening with a cylindrical edge formed vertically into the lower surface of the second lateral wall 27R. An inner diameter of the second positioning portion 72 is substantially larger than an outer diameter of the cylindrical part of the first positioning portion 71. In other words, the second positioning portion 72 may be an opening, in which the protruded shape of the first positioning portion 71 may fit. As shown in FIG. 4, an upper end of the second positioning portion 72 is open in an inner room inside the second lateral wall 27R.

As the second housing 20 descends form the open posture shown in FIG. 6, the frustum conical part of the protruded first positioning portion 71 may enter the second positioning portion 72 being the round opening, as shown in FIG. 5.

As the second housing 20 descends further to the closed posture as shown in FIG. 4, the cylindrical part of the first positioning portion 71 may fit with the second positioning portion 72, and the frustum conical part of the first positioning portion 71 may protrude upward to be higher than the second positioning portion 72. Therefore, the second positioning portion 72 may engage with the first positioning portion 71 so that the second housing 20 may be placed at a correct position with respect to the first housing 10.

With the engagement between first positioning portion 71 and the second positioning portion 72, the second housing 20 may be placed at a correct position with respect to the first housing 10 so that positional relation between the parts attached to the first housing 10 and the parts attached to the second housing 20 may be maintained. Therefore, the image forming unit 2 may conduct the image forming operation correctly. Meanwhile, displacement between the exterior visual of the first housing 10 and the exterior visual of the second housing 20 may be restrained. In other words, the exterior visual quality of the image forming apparatus 1 may be maintained.

<Interlocking Assembly between the First Housing and the Second Housing>

Between the first housing 10 and the second housing 20, arranged is an interlocking assembly. The interlocking assembly is a safety equipment that allows the image forming unit 2 to operate while the second housing 20 is in the closed posture with respect to the first housing 10 as shown in, for example, FIG. 1, but prohibit the image forming unit 2 from operating while the second housing 20 is in the open posture with respect to the first housing 10 as shown in, for example, FIG. 3.

As shown in FIGS. 3-7, the interlocking assembly includes a supported member 110 having a protrusion 111 and a contact portion 112, a tension coil spring 119, an aperture 101, a sensor 90, and an actuator 103.

The supported member 110 as shown in, for example, FIG. 4 is arranged on the rightward side of the second housing 20. The supported member 110 is swingably supported either directly or indirectly by the second housing 20. For example, the supported member 110 may be supported by the second housing 20 through a frame (not shown) inside the second lateral wall 27R of the second housing 20 to swing about a swing axis X11, which extends in the crosswise direction at a position spaced apart frontward and upward from the second positioning portion 72.

The supported member 110 extends frontward from the swing axis 110 and bends to point downward. The downward pointing part of the supported member 110 forms the protrusion 111. In other words, the protrusion 111 is located frontward with respect to the swing axis 110. The protrusion 111 is located on the rightward side of the second housing 20.

The supported member 110, moreover, extends rearward from the swing axis 110, and a rear end portion of the supported member 110 is located above the second positioning portion 72. The rear end portion of the supporting part 110 forms the contact portion 112. In other words, the contact portion 112 is located rearward from the swing axis X110.

As shown in FIGS. 3 and 4, vertically through the lower surface of the second lateral wall 27R of the second housing 20, formed is an insertion hole 27H. The insertion hole 27H is formed at a position apart frontward from the second positioning portion 72 and vertically coincident with the protrusion 111 so that the protrusion 111 may be inserted in the insertion hole 27H. The insertion hole 27H may have an approximately rectangular shape, of which outline is substantially small to keep the user's finger from entering.

The protrusion 111 is movable between a first position shown in FIG. 4 and a second position shown in FIGS. 3, 5, and 6, as the supported member 110 swings about the swing axis X110. The protrusion 111 protrudes, when in the first position as shown in FIG. 4, downward through the insertion hole 27H in the second housing 20 at least partly outside the second housing 20. When in the second position as shown in, for example, FIG. 5, the protrusion 111 retracts inside the second lateral wall 27R of the second housing 20, without protruding outside the second housing 20. In other words, the second position is a more inward position in the second housing 20 than the first position. For example, a lower end of the protrusion 111 may be located at a same level as the lower surface of the second housing 20. For another example, the lower end of the protrusion 111 may be located at a position higher than the lower surface of the second housing 20.

As shown in FIGS. 4 and 5, the tension coil spring 119 is arranged inside the second lateral wall 27R of the second housing 20. The tension coil spring 119 is attached to the supported member 110 at a position closer to the protrusion 111 rather than the contact portion 112. The tension coil spring 119 may pull, or urge, the protrusion 111 upward toward the second position as shown in, for example, FIG.

5. The protrusion 111 urged by the tension coil spring 119 upward may contact a stopper 110S to stay at the second position.

As shown in FIGS. 3 and 4, vertically through an upper surface of the first lateral wall 17R of the first housing 10, formed is the aperture 101. In other words, the aperture 101 being a vertical opening is formed on the rightward side of the first housing 10. The aperture 101 is formed at a position apart frontward from the first positioning portion 71 and coincident with the protrusion 111 protruding downward from the second housing 20 so that the protrusion 111 moved to the first position, as shown in FIG. 4, may be inserted in the aperture 101. The aperture 101 has an outline in an approximately rectangular shape, which is substantially small to keep the user's finger from entering. Meanwhile, the protrusion 111 has a substantially small size to be inserted in the aperture 101. For example, the protrusion 111 may have a shape of a prong, of which cross-sectional shape is smaller than the aperture 101.

Figure 7:
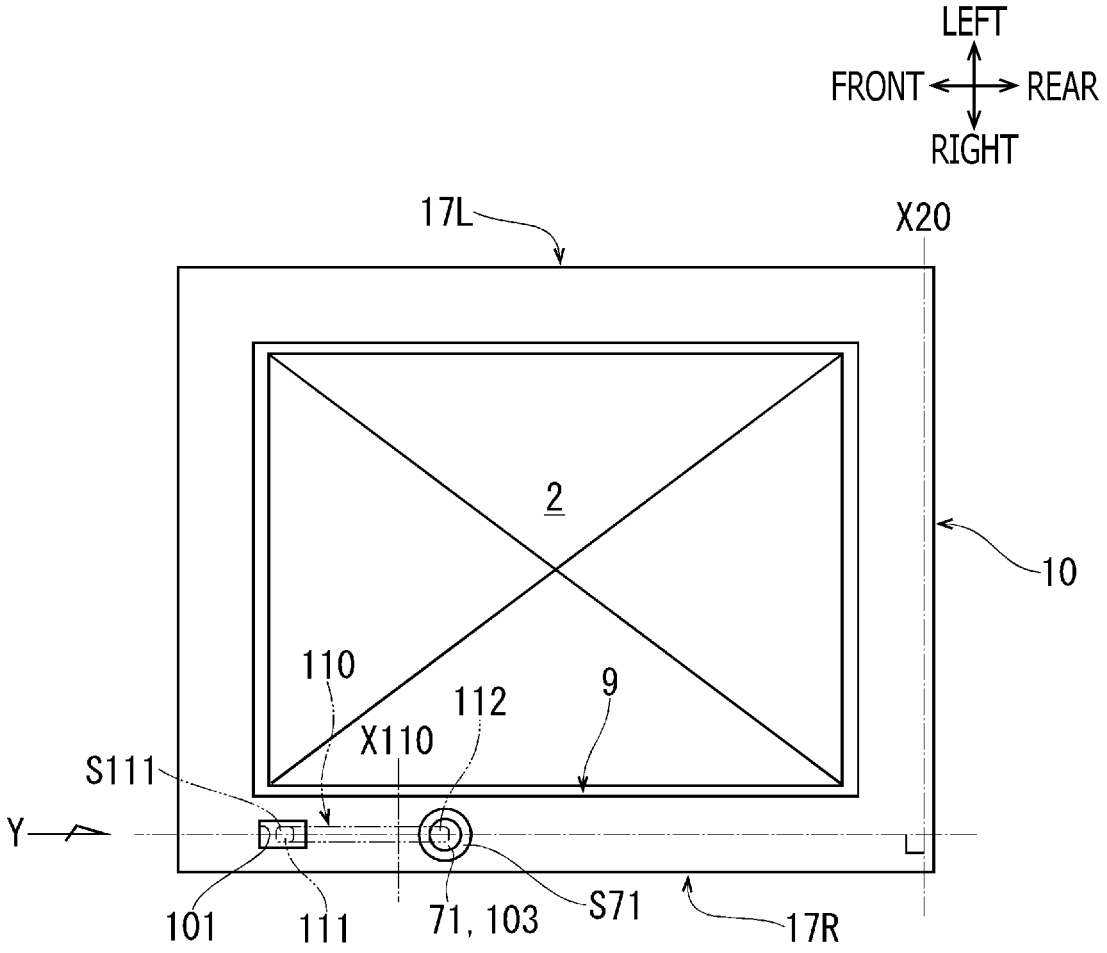
FIG. 7 is a top plan view of the first housing, viewed along a direction Z indicated in FIG. 6, in the image forming apparatus according to the first embodiment of the present disclosure.

Meanwhile, the first positioning portion 71 having the protruded shape is larger than the protrusion 111. As shown in FIG. 7, in the top plan view along the vertical direction, a plane area S71 of the cylindrical portion in the first positioning portion 71 is larger than a plane area S111 of the protrusion 111.

As shown in, for example, FIG. 4, the first positioning portion 71 and the second positioning portion 72 are located to be closer than the protrusion 111 and the aperture 101 to the open/close axis X20.

The actuator 103 is the same part of the first housing 10 as the first positioning portion 71 protrudes upward. In other words, the actuator 103 may serve as the first positioning portion 71, and the first positioning portion 71 may serve as the actuator 103. The actuator 103 being the first positioning portion 71, which has the form described earlier, has the top plane surface that may contact the contact portion 112 of the supported member 110 located above the second positioning portion 72.

As shown in FIG. 7, the actuator 103, i.e., the first positioning portion 71, and the aperture 101 are arranged at positions to overlap each other in a view along a direction orthogonal to the open/close axis 20, as indicated by an arrow Y.

As the second housing 20 descends from the position shown in FIG. 6 in the open posture, as shown in FIG. 5, the actuator 103, i.e., the first positioning portion 71, engages with the second positioning portion 72 before the protrusion 111 enters the aperture 101.

As the second housing 20 descends further downward to the closed posture at the position shown in FIG. 4, the frustum conical part of the actuator 103 being the first positioning portion 71 protrudes to be higher than the second positioning portion 72 and contacts the contact portion 112 of the supported member 110 to push the contact portion 112 upward. Therefore, the actuator 103 being the first positioning portion 71 may move the supported member 110 to swing counterclockwise in FIG. 4 against the urging force of the tension coil spring 119 with the protrusion 111 moving to the first position. As a result of this movement, the protrusion 111 is inserted in the aperture 101.

On the other hand, as shown in FIGS. 5 and 6, when the second housing 20 is in the open posture, the actuator 103 being the first positioning portion 71 separates from the contact portion 112 and the second positioning portion 72. Therefore, the actuator 103 being the first positioning portion 71 may cause the supported member 110 to swing clockwise in FIG. 4 with the urging force of the tension coil spring 112 and to move the protrusion 111 to the second position. As a result of this movement, the protrusion 111 may retract inside the second lateral wall 27R of the second housing 20.

As shown in FIGS. 4-6, the sensor 90 is arranged inside the first lateral wall 17R of the first housing 10. The sensor 90 may detect the protrusion 111 inserted in the aperture 101 and includes an interlocking arm 91, a tension coil spring 99, and an interlocking switch 92.

The interlocking arm 91 has an approximately rectangular shape, in a view along the crosswise direction, with a lower side curving downward. The interlocking arm 91 may be swingably supported either directly or indirectly by the first housing 10. For example, the interlocking arm 91 may be swingably supported by the first housing 10 through a frame (not shown) in the first housing 10 to swing about a swing axis X91, which extends in the crosswise direction at an upper-rearward corner thereof. A frontward part of an upper side of the interlocking arm 91 is located straight below the aperture 101.

The tension coil spring 99 is attached to a lower-frontward corner of the interlocking arm 91. The tension coil spring 99 pulls, or urges, the interlocking arm 91 in a clockwise direction which is centered about the swing axis X91. The interlocking arm 91 pulled by the tension coil spring 99 may contact a stopper 91S, in other words, may be urged against the stopper 91S, to stay at a non-detectable position as shown in FIG. 5.

The interlocking switch 92 may be a micro-switch, in which electrical contacts may be connected with or disconnected from each other as a movable piece 92A is pushed or released. The interlocking switch 92 is connected to the controller C1.

The movable piece 92A in the interlocking switch 92 is located to be apart rearward from the lower side of the interlocking arm 91 being at the non-detectable position (see FIG. 5).

As shown in FIG. 4, when the second housing 20 is closed, the protrusion 111 is inserted in the aperture 101, and the lower end of the protrusion 111 contacts the upper side of the interlocking arm 91 and moves the interlocking arm 91 to swing in a counterclockwise direction, which is centered about the swing axis X91, against the urging force of the tension coil spring 99. Therefore, the interlocking arm 91 may move to a detectable position shown in FIG. 4 to push the movable piece 92A in the interlocking switch 92. As a result of this movement, the interlocking switch 92 may detect the protrusion 111 and transmit a detection signal to the controller C1.

The controller C1 may determine that the image forming unit 2 is operable under a condition where the interlocking switch 92 detects the protrusion 111. On the other hand, the controller C1 may prohibit the image forming unit 2 from operating under a condition where the interlocking switch 92 is not detecting the protrusion 111. The controller C1 may, for example, display a message in the operation panel 20P to inform the user that the image forming unit 2 is inoperable.

According to the first embodiment of the present disclosure, the image forming apparatus 1 includes an open/close assembly, having the first housing 10, the second housing 20, the protrusion 111, the tension coil spring 119, the aperture 101, the sensor 90, and the actuator 103. The open/close assembly further includes the first positioning portion 71, which is the same part of the first housing 10 as the actuator 103 and the second positioning portion 72. The protrusion 111 and the contact portion 112 are portions in the supported member 110.

<Benefits>

In the image forming apparatus 1 according to the first embodiment, as shown in FIG. 4, the actuator 103, which is the first positioning portion 71, may place the protrusion 111 at the first position when the second housing 20 is closed. The protrusion 111 may protrude downward through the insertion hole 27H formed in the second housing 20 and enter the aperture 101. In the sensor 90, the interlocking arm 91 may move to the detectable position to push the movable piece 92A in the interlocking switch 92. Therefore, the interlocking switch 92 may detect the protrusion 111 entering the aperture 101 correctly.

Moreover, as shown in FIGS. 3, 5, and 6, the actuator 103, i.e., the first positioning portion 71, may cause the protrusion 111 to move the second position as the second housing 20 is being opened. In particular, the protrusion 111 may be urged to move to the second position by the tension coil spring 119. Therefore, the protrusion 111 may retract inside the second lateral wall 27R of the second housing 20. As a result, the protrusive amount of the protrusion 111 becomes less and less to none as the second housing 20 is in the wider open posture as shown in FIG. 6. Therefore, the protrusion 111 may be restrained from being interfered with by other members or items. For example, if the protrusion 111 stays at the first position as the second housing 20 is opened wider, the protrusion 111 may be touched unintentionally by the user or collide with other objects. In this regard, with the protrusion 111 that is retractable inside the second lateral wall 27R in the second housing 20, the protrusion 111 may be prevented from such unintentional touch or collision.

In this regard, the image forming apparatus 1 may restrain the protrusion 111, which is the detectable object to the sensor 90, from deformation or damage. Moreover, a situation such that the controller C1 may not determine whether the second housing 20 is closed or open due to deformation or damage of the protrusion 111, and because the sensor 90 cannot detect the deformed or damaged protrusion 111 while the second housing 20 is in the closed posture, may be restrained. In other words, based on the detected result from the sensor 90, the controller C1 may control the image forming unit 2 correctly. In particular, the controller C1 may determine correctly that the second housing 20 is closed when the interlocking switch 92 detects the protrusion 111 and may operate the image forming unit 2 securely. On the other hand, the controller C1 may determine correctly that the second housing 20 is open when the interlocking switch 92 detects no protrusion 111 and may prohibit the image forming unit 2 from operating.

Moreover, as shown in FIG. 5, the first positioning portion 71 may engage with the second positioning portion 72 before the protrusion 111 enters the aperture 101. In other words, when the second housing 20 is being closed, the second housing 20 may be placed at the correct position with respect to the first housing 10 by the engagement between the first positioning portion 71 and the second positioning portion 72 occurring earlier, and thereafter, as shown in FIG. 4, the protrusion 111 may enter the aperture 101, which has the size to restrict the user's finger from entering. Thereby, at the instant when the second housing 20 is closed, and while the second housing 20 is closed, the protrusion 111 and the aperture 101 may be maintained within a correct positional range from each other without being displaced. Therefore, deformation and damage in the protrusion 111 may be restrained more effectively. Meanwhile, neither the protrusion 111 nor the aperture 101 serves as a positioning portion as the first positioning portion 71 and the second positioning portion 72 may serve. Therefore, for example, when the image forming apparatus 1 falls on a floor, and if a force that may cause displacement between the second housing 20 and the first housing 10 may be applied to the image forming apparatus 1, the force may be split between the first positioning portion 71 and the second positioning portion 72 while the protrusion 111 may be prevented from being affected by the force. In this regard, deformation and damage in the protrusion 111 may be restrained more effectively.

Moreover, as shown in FIGS. 4-6, the first positioning portion 71 having the protruded shape is larger than the protrusion 111. In particular, as shown in FIG. 7, the plane area S71 of the cylindrical portion in the first positioning portion 71 is larger than the plane area S111 of the protrusion 111. Therefore, even when a force that may cause displacement between the second housing 20 and the first housing 10 is applied to the image forming apparatus 1, the force may be absorbed by the first positioning portion 71 having the protruded shape, which is larger than the protrusion 111, and the second positioning portion 72 being the round opening, in which the cylindrical portion of the first positioning portion 71 may fit, securely. Therefore, the protrusion 111 may be prevented from being affected by the force. In this regard, deformation and damage in the protrusion 111 may be restrained more effectively.

Moreover, as shown in FIGS. 3-6, the second housing 20 may swing about the open/close axis X20 to be open or closed to the first housing 10. Meanwhile, the first positioning portion 71 and the second positioning portion 72 are located closer than the protrusion 111 or the aperture 101 to the open/close axis X20. Therefore, in the image forming apparatus 1, compared to an image forming apparatus, in which the first positioning portion 71 and the second positioning portion 72 are located to be farther than the protrusion 111 and the aperture 101 from the open/close axis 20, heights of the first positioning portion 71 and the second positioning portion 72 may be reduced.

Moreover, as shown in FIG. 3, the first positioning portion 71 and the second positioning portion 72, which mate with each other, and the protrusion 111 and the aperture 101, which mate with each other, are arranged on the rightward side of either the first housing 10 or the second housing 20. In particular, the first positioning portion 71 and the protrusion 111 are located on the rightward side of the first housing 10, and the second positioning portion 72 mating with the first positioning portion 71 and the aperture 101 mating with the protrusion 111 are arranged on the rightward side of the second housing 20. In this regard, the first positioning portion 71 and the second positioning portion 72, and the protrusion 111 and the aperture 101, may be arranged within a close range so that the positioning accuracy between the protrusion 111 and the aperture 101 may be maintained or improved. Moreover, if a force that may cause displacement between the second housing 20 and the first housing 10 may be applied to the image forming apparatus 1, the force may be split between the first positioning portion 71 and the second positioning portion 72 located in the close range from the protrusion 111 and the aperture 101 so that the protrusion 111 may be prevented from being affected by the displacing force. In this regard, deformation and damage in the protrusion 111 may be restrained more effectively.

Moreover, as shown in FIG. 7, the actuator 103 being the first positioning portion 71 and the aperture 101 are located at positions to overlap each other in the view along the direction orthogonal to the open/close axis 20, as indicated by the arrow Y. In other words, the actuator 103 being the first positioning portion 71 and the aperture 101 align in the direction orthogonal to the open/close axis, e.g., the front-rear direction. Therefore, the positional accuracy between the aperture 101 and the protrusion 111, which is the object of the action by the actuator 103, may be maintained or improved easily.

Moreover, as shown in FIG. 4, the actuator 103 is the same part of the first housing 10 as the first positioning portion 71 having the protruded shape. In other words, the first positioning portion 71 to locate the first housing 10 and the second housing 20 at the mutually correct positions may serve as the actuator 103. In this regard, a quantity of parts in the image forming apparatus 1 may be reduced, and manufacturing cost may be lowered.

Moreover, as shown in, for example, FIG. 4, the supported member 110, which is swingably supported by the second housing 20, includes the protrusion 111 and the contact portion 112. When the second housing 20 is being closed, the actuator 103 being the first positioning portion 71 arranged in the first housing 10 may contact the contact portion 112, causing the supported member 110 to swing about the swing axis X110. With this simplified mechanism, when the second housing 20 is being closed, the protrusion 111 may be moved easily from the second position shown in, for example, FIG. 5 to the first position shown in FIG. 4.

Second Embodiment

In the following paragraphs, described with reference to FIGS. 8-10 will be a second embodiment of the present disclosure. An image forming apparatus in the second embodiment has a supported member 210, a protrusion 211, a contact portion 212, a linear-motion guide 227G1, and a compressed coil spring 219, rather than the supported member 110, the protrusion 111, the contact portion 112, and the tension coil spring 119 in the image forming apparatus 1 in the first embodiment. Moreover, the image forming apparatus in the second embodiment has a link 281R, a slider 283, a linear-motion guide 227G2, and a tension coil spring 282 rather than the link 81R, the tension coil spring 82, the guide pin 81G, and the guide rail 27G in the image forming apparatus 1 in the first embodiment. The remaining structure of the image forming apparatus in the second embodiment may be identical to the structure of the image forming apparatus 1 in the first embodiment and will be referred to by the same reference signs, and description of those will be herein omitted.

The supported member 210, the protrusion 211, the contact portion 212, the linear-motion guide 227G1, the compressed coil spring 219, the link 281R, the slider 283, the linear-motion guide 227G2, and the tension coil spring 282 are arranged on the rightward side of either the first housing 10 or the second housing 20.

The supported member 210 is movably supported by the linear-motion guide 227G1 to linearly move in the vertical direction on the inner side of the second lateral wall 27R of the second housing 20. A downward pointing part at a frontward and downward corner of the supported member 210 forms the protrusion 211. An oblique surface formed at an upper-rearward part of the supported member 210 forms the contact portion 212.

A lower end of the arm-like link 281R is coupled to an upper end of the first lateral wall 17R of the first housing 10. The slider 283 is movably supported by the linear-motion guide 227G2 to move linearly in the front-rear direction inside the second lateral wall 27R of the second housing 20. A frontward end of the slider 283 forms the actuator 203, which has a tapered shape. By the tapered surface, the actuator 203 may contact the oblique surface of the contact portion 212.

An upper end of the link 281R is coupled to a rearward end of the slider 283. The rearward end of the slider 283 is pulled, or urged, rearward by the tension coil spring 282, which is arranged inside the second lateral wall 27R of the second housing 20.

The compression coil spring 219 urges the supported member 210 upward. As shown in FIG. 8, when the second housing 20 is in the closed posture, the actuator 203 in the slider 283 being pushed frontward by the link 281R may contact the contact portion 212 and push the supported member 210 downward against the urging force of the compression coil spring 219. Therefore, the protrusion 211 may move downward through the insertion hole 27H in the second housing 20 to the first position and enter the aperture 101.

Figure 9:
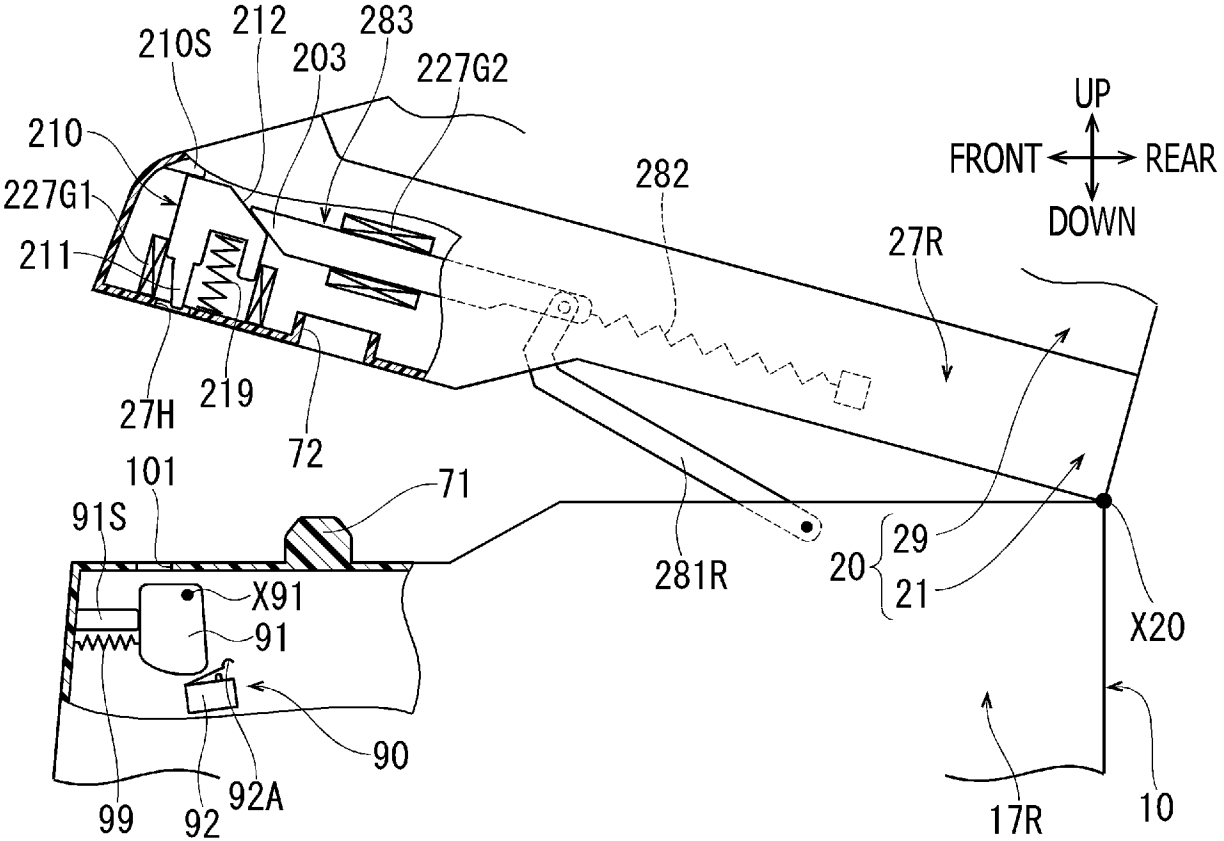
FIG. 9 is an illustrative cross-sectional partial view of the image forming apparatus, including the link, the protrusion, the compressed coil spring, the aperture, the sensor, and the actuator, with the second housing being in an open posture with respect to the first housing, according to the second embodiment of the present disclosure.

On the other hand, as shown in FIG. 9, when the second housing 20 moves to the open posture, the slider 283 may be pulled by the link 281 to move rearward. Therefore, a position of the contact between the actuator 203 and the actuator 203 may move, and the supported member 210 may be lifted upward by the urging force of the compression coil spring 219. Moreover, the upper end of the supported member 210 may contact a stopper 210S, in other words, may be urged against the stopper 210S, so that the protrusion 211 may stay at the second position, in which the protrusion 211 retracts inside the second lateral wall 27R of the second housing 20. As shown in FIG. 10, when the second housing 20 is moved to the wider open posture, the slider 283 may be pulled by the link 281R to move further rearward, and the actuator 203 may separate from the contact portion 212. Thus, the slider 283 may move in conjunction with the opening and closing motions of the second housing 20 to separate from and contact the contact portion 212.

Meanwhile, the tension coil spring 282 may accumulate the resilient force therein and release the resilient force therefrom as the slider 283 moves in the front-rear direction. Therefore, by the aid of resilient force, the second housing 20 may be lifted by a smaller amount of lifting force.

Figure 8:
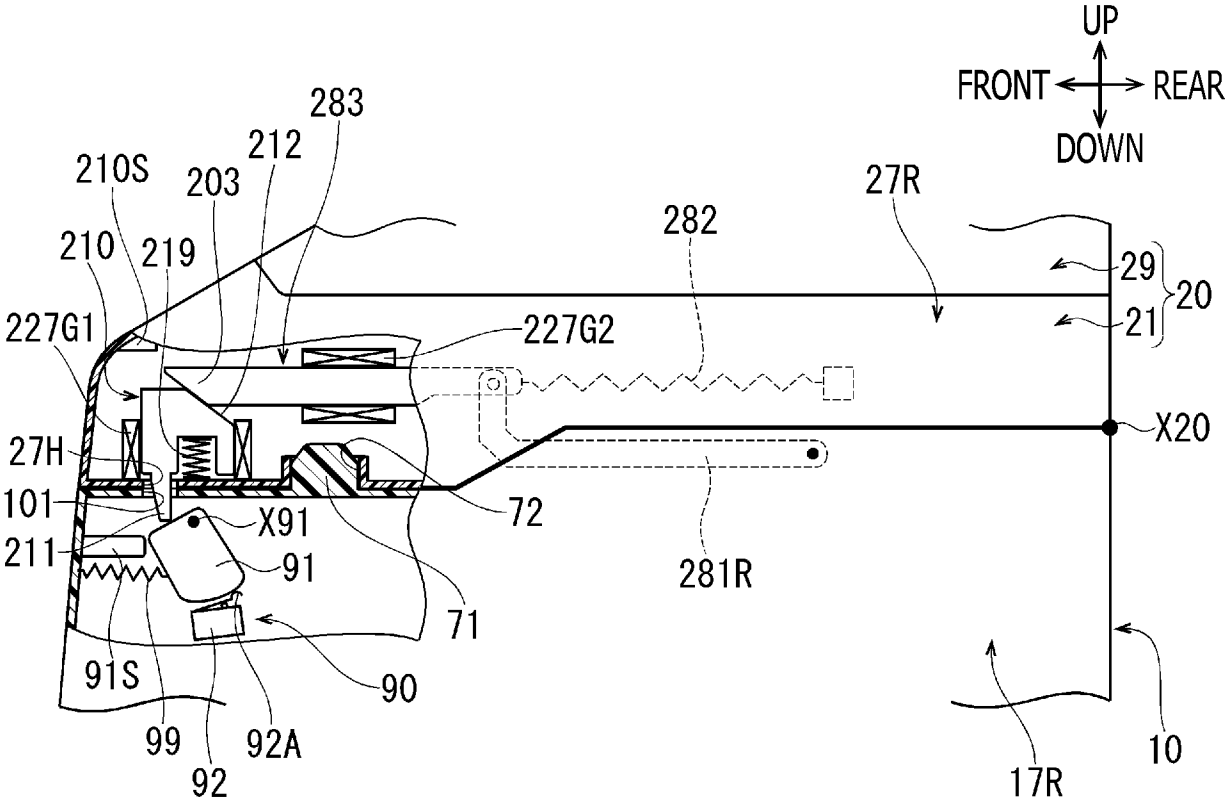
FIG. 8 is an illustrative cross-sectional partial view of an image forming apparatus, including a link, a protrusion, a compressed coil spring, an aperture, a sensor, and an actuator, with the second housing being a closed posture with respect to the first housing, according to a second embodiment of the present disclosure.

In the image forming apparatus according to the second embodiment, as shown in FIG. 8, the actuator 203 in the slider 283 may move the protrusion 211 to the first position to enter the aperture 101 as the second housing 20 is being closed. Therefore, the interlocking arm 91 in the sensor 90 may move to the detectable position to push the movable piece 92A so that the interlocking switch 92 may detect the protrusion 211 in the aperture 101 correctly.

Figure 10:
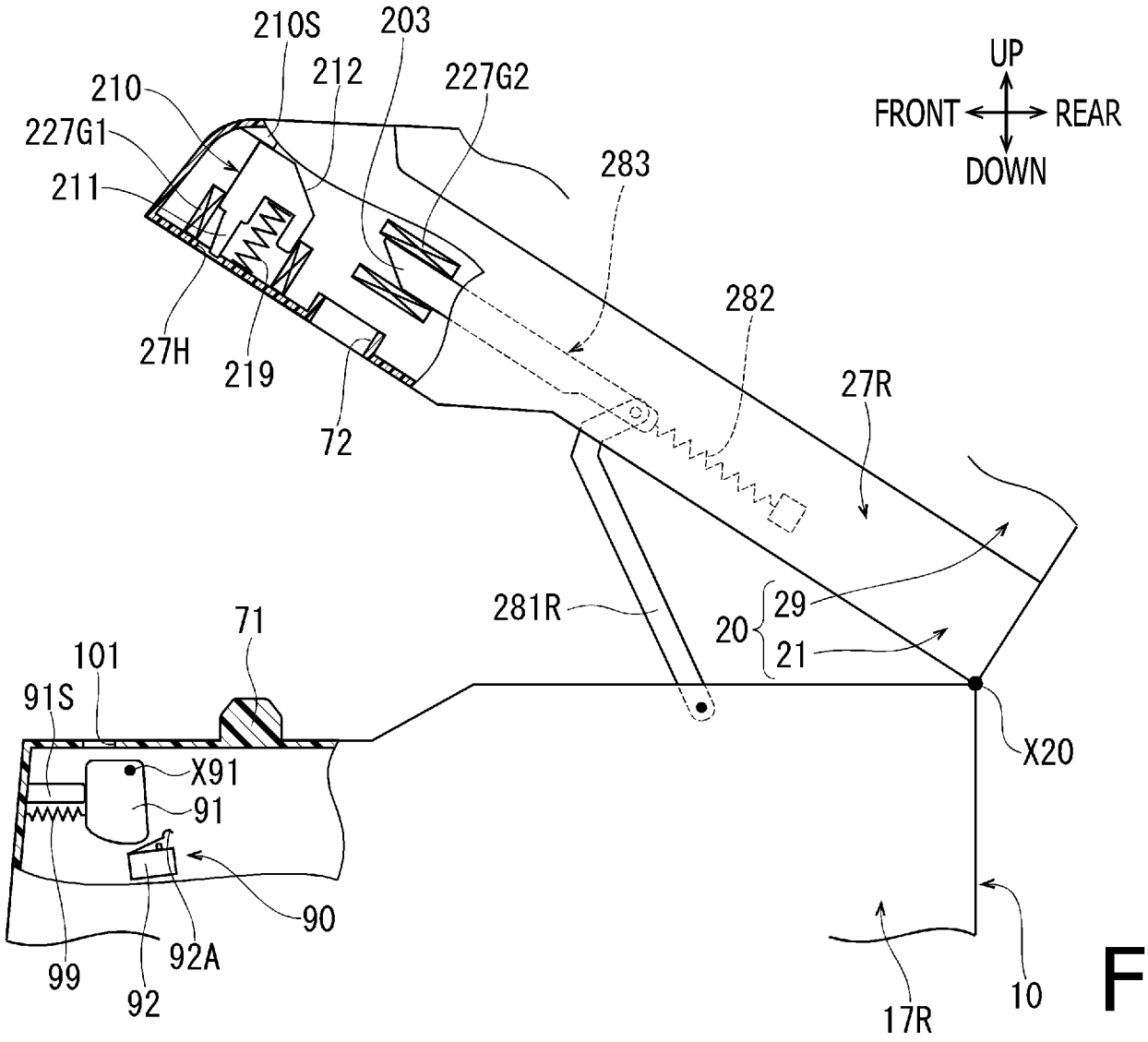
FIG. 10 is an illustrative cross-sectional partial view of the image forming apparatus, including the link, the protrusion, the compressed coil spring, the aperture, the sensor, and the actuator, with the second housing being in a wider open posture with respect to the first housing, according to the second embodiment of the present disclosure.

Moreover, as shown in FIGS. 9 and 10, the actuator 203 may move the protrusion 211 to the second position as the second housing 20 is being opened. Meanwhile, the protrusion 211 may be urged by the compression coil spring 219 to the second position. As a result, the protrusion 211 may retract inside the second lateral wall 27R of the second housing 20; therefore, the protrusion 211 may be restrained from being interfered with by other members or items.

In this regard, similarly to the image forming apparatus 1 in the first embodiment, the protrusion 211, which is the detectable object to the sensor 90, may be restrained from being deformed or damaged.

Moreover, the protrusion 211 may be moved between the first position, as shown in FIG. 8, and the second position, as shown in FIGS. 9 and 10, by the simple movement of the link 281R, which supports the second housing 20, and the slider 283.

Third Embodiment

In the following paragraphs, described with reference to FIG. 11 will be a third embodiment of the present disclosure. An image forming apparatus in the third embodiment has a link 381R and a slider 383 rather than the link 281R, the slider 283, and the tension coil spring 282 in the image forming apparatus in the second embodiment. The remaining structure of the image forming apparatus in the third embodiment may be identical to the structure of the image forming apparatus 1 in the first embodiment and the image forming apparatus in the second embodiment and will be referred to by the same reference signs, and description of those will be herein omitted. The link 381R and the slider 383 are arranged on the rightward side of the image forming apparatus.

The link 381R includes a sector gear 381A and transmission gears 381B, 381C, 381D. The sector gear 381A is arranged at a rear end of the first lateral wall 17R of the second housing 10. Teeth in the sector gear 381A area arranged on an arc of the sector that is centered about the open/close axis X20. The transmission gears 381B, 381C, 381D are arranged rotatably inside the second lateral wall 27R of the second housing 20. The transmission gear 381B meshes with the sector gear 381A, the transmission gear 381C meshes with the transmission gear 381B, and the transmission gear 381D meshes with the transmission gear 381C.

The slider 383 may be in a form similar to the slider 283 in the second embodiment except a rearward part thereof. In other words, the slider 383 has the actuator 203 in the tapered shape in a frontward part thereof, similarly to the slider 283 in the second embodiment. The rearward part of the slider 383 extends rearward in the second housing 20 and has a rack gear 383G on a lower edge thereof. The rack gear 383G meshes with the transmission gear 381D.

Figure 11:
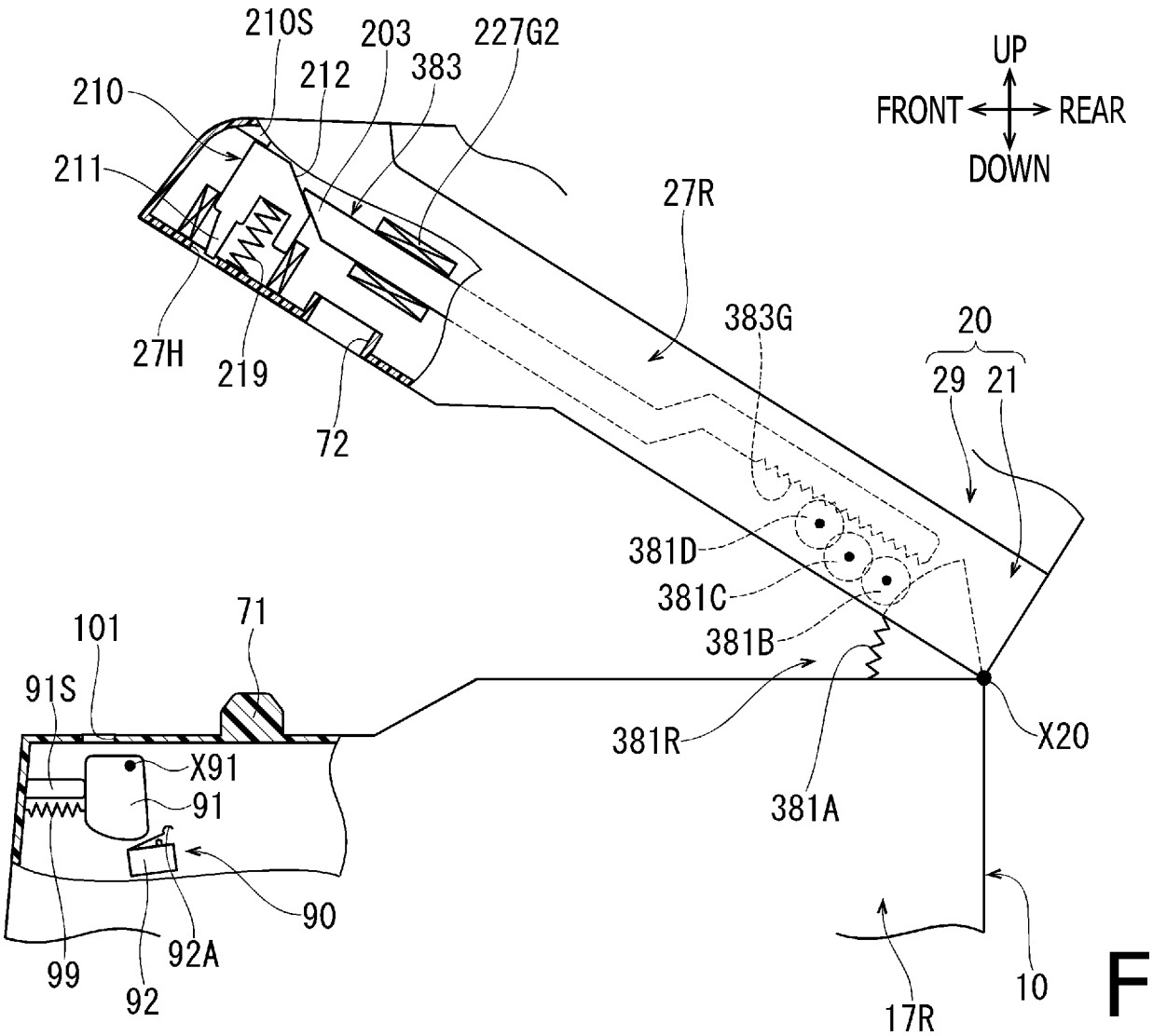
FIG. 11 is an illustrative cross-sectional partial view of the image forming apparatus, including a link, a protrusion, a compressed coil spring, an aperture, a sensor, and an actuator, with the second housing being in a closed posture with respect to the first housing, according to a third embodiment of the present disclosure.

As shown in FIG. 11, when the second housing 20 is in the open posture, the second housing 20 may be held open as the actuator 203 in the slider 383 abuts on the contact portion 212 in the supported member 210, which is urged by the compression coil spring 219. In the second housing 20 in this posture, the protrusion 211 may be maintained at the second position.

Meanwhile, as the second housing 20 is moved to descend, although not shown in the drawings, the sector gear 381 and the transmission gears 381B, 381C, 381D may cooperate to move the rack gear 383G frontward. As a result, the actuator 203 in the slider 383 may abut on the contact portion 212 to cause the supported member 210 to move downward against the urging force of the compression coil spring 219, and the protrusion 211 may move to the first position.

In this regard, similarly to the image forming apparatus 1 in the first embodiment and the image forming apparatus in the second embodiment, the protrusion 211, which is the detectable object to the sensor 90, may be restrained from being deformed or damaged.

Moreover, the protrusion 211 may be moved between the first position and the second position by the simple mechanism of the link 381R, which supports the second housing 20, and the slider 383.

Moreover, with the compression coil spring 219 urging the slider 383 rearward, the link 381R may hold the second housing 20 in the open posture. In other words, the compression coil spring 219 may serve to urge the link 381R rearward, similarly to the tension coil springs 82, 282; therefore, a quantity of parts in the image forming apparatus 1 may be reduced, and manufacturing cost may be lowered.

Although examples of carrying out the invention has been described, those skilled in the art will appreciate that there are numerous variations and permutations of the open/close device and the image forming apparatus that fall within the spirit and scope of the invention as set forth in the appended claims. It is to be understood that the subject matter defined in the appended claims is not necessarily limited to the specific features or act described above. Rather, the specific features and acts described above are disclosed as example forms of implementing the claims.

For example, the first positioning portion 71 and the second positioning portion 72 may not necessarily be in the protruded and unclosed shapes, respectively. The second positioning portion may protrude, and the first positioning portion may be unclosed, in which the second positioning portion may fit. For another example, the shapes of the first positioning portion and the second positioning portion may not necessarily be limited as described above as long as the first positioning portion and the second positioning portion may locate the first housing 10 and the second housing 20 to relatively correct positions. For example, the forms of the first positioning portion and the second positioning portion may not necessarily be limited to the cylinder and the round opening but may be a column and a rectangular opening, in which the column may fit.

For another example, the second housing 20 may not necessarily include the flatbed 29, but the flatbed 29 may be replaced with an upper cover, on top of which an ejection tray is formed. For another example, the present disclosure may be applied to an open/close assembly having a first housing being a flatbed and a second housing, which is openable/closable, to stow an auto-document feeder.

For another example, the present disclosure may be applied to an open/close assembly having a first housing, which is open frontward, and a second housing being a front cover to cover or expose the front side of the first housing. In this open/close assembly, the first positioning portion and the second positioning portion may be arranged at positions that are closer to an open/close axis of the front cover than the protrusion and the aperture. In this arrangement, dimensions of the first positioning portion and the second positioning portion in the front-rear direction may be reduced.

For another example, the aperture 101 and the sensor 90 may not necessarily be arranged in the first housing 10 but may be arranged in the second housing. While the aperture and the sensor are arranged in the second housing, a protrusion and an urging member which are similar to the protrusions 111, 211 and the coil springs 119, 219 in the first through the third embodiments may be arranged in the first housing so that a protrusive amount of the protrusion when the second housing is in the open posture may be reduced, and deformation and damage in the protrusion to be detected by the sensor may be restrained.

For another example, the present disclosure may not necessarily be applied to the image forming apparatus 1 being a laser printer but may be applied to, for example, another type of image forming apparatus, an image reading apparatus, and a multifunction peripheral machine, having a housing and a processing unit stowed in the housing.

What is claimed is:

1. An open/close assembly, comprising:

a first housing including an aperture;

a second housing configured to be openable and closable to the first housing;

a first protrusion arranged in the second housing, the first protrusion being movable between a first position, in which the first protrusion protrudes from the second housing, and a second position being more inward in the second housing than the first position, the first protrusion protruding from the second housing being configured to be inserted in the aperture in a condition where the second housing is closed;

a spring arranged in the second housing, the spring being configured to urge the first protrusion toward the second position;

a sensor arranged in the first housing, the sensor being configured to detect the first protrusion inserted in the aperture; and an actuator having a surface configured to move the first protrusion to the first position when the second housing is being closed and to move the first protrusion to the second position when the second housing is being opened.

2. The open/close assembly according to claim 1, wherein the first housing comprises a first positioning portion, wherein the second housing comprises a second positioning portion configured to locate the second housing at a correct position with respect to the first housing by engaging with the first positioning portion, and wherein the second positioning portion is configured to engage with the first positioning portion before the first protrusion is inserted in the aperture.

3. The open/close assembly according to claim 2, wherein one of the first positioning portion and the second positioning portion includes a second protrusion, wherein the other of the first positioning portion and the second positioning portion not including the second protrusion is recessed to fit with the second protrusion, and wherein a plane area of the second protrusion is larger than a plane area of the first protrusion in a view along a direction orthogonal to an open/close axis.

4. The open/close assembly according to claim 2, wherein the second housing is configured to move with respect to the first housing to open and close by swinging about an open/close axis, and wherein the first positioning portion and the second positioning portion are located closer than the first protrusion and the aperture to the open/close axis.

5. The open/close assembly according to claim 4, wherein the open/close axis extends in a widthwise direction of the first housing and the second housing, wherein the first positioning portion and the first protrusion are arranged on a side of the first housing toward one end in the widthwise direction, and the second positioning portion and the aperture are arranged on a side of the second housing toward the one end in the widthwise direction.

6. The open/close assembly according to claim 5, wherein the actuator is arranged in the first housing, and wherein the actuator and the aperture are located at positions to overlap each other in a view along a direction orthogonal to the open/close axis.

7. The open/close assembly according to claim 5, wherein the first positioning portion is a part of the first housing having a protruded shape, wherein the second positioning portion is recessed to fit with the protruded shape of the first positioning portion, and wherein the actuator is the same part of the first housing as the first positioning portion.

8. The open/close assembly according to claim 1, further comprising:

a supported member arranged in the second housing, the supported member being configured to swing about a swing axis, wherein the supported member includes the first protrusion on one side thereof with respect to the swing axis and a contact portion on the other side thereof with respect to the swing axis, and wherein the actuator is arranged in the first housing, the actuator having a protruded shape with the surface being configured to contact the contact portion.

9. The open/close assembly according to claim 1, further comprising:

a link arranged between the first housing and the second housing, the link being configured to support the second housing being in an open posture, wherein the actuator is a slider arranged in the second housing, the actuator being coupled with the link and configured to move in conjunction with opening and closing motions of the second housing.

10. An image forming apparatus, comprising:

an open/close assembly, including:

a first housing including an aperture;

a second housing configured to be openable and closable to the first housing;

a first protrusion arranged in the second housing, the first protrusion being movable between a first position, in which the first protrusion protrudes from the second housing, and a second position being more inward in the second housing than the first position, the first protrusion protruding from the second housing being configured to be inserted in the aperture in a condition where the second housing is closed;

a spring arranged in the second housing, the spring being configured to urge the first protrusion toward the second position;

a sensor arranged in the first housing, the sensor being configured to detect the first protrusion inserted in the aperture; and an actuator having a surface configured to move the first protrusion to the first position when the second housing is being closed and to move the first protrusion to the second position when the second housing is being opened; and an image forming unit configured to form an image on a sheet, the image forming unit being arranged in the first housing and the second housing of the open/close assembly.

* * * * *